US005336562A

United States Patent [19]

Forero

[11] Patent Number: 5,336,562

[45] Date of Patent: Aug. 9, 1994

[54] POLYOLEFINE YARNS WITH GOOD PERFORMANCE FOR RUGS AND CARPETS AND METHOD OF PRODUCING THE SAME

[75] Inventor: Miguel Forero, Bogota, Colombia

[73] Assignee: Pavco S.A., Santafe de Bogota, Colombia

[21] Appl. No.: 925,964

[22] Filed: Aug. 5, 1992

[30] Foreign Application Priority Data

Feb. 28, 1992 [CO] Colombia ..... 356239

[51] Int. Cl.[5] ..... D02G 3/00

[52] U.S. Cl. ..... 428/373; 428/198; 428/293; 428/370; 57/204; 57/205; 57/206; 57/208; 57/209; 57/245; 57/905; 156/166

[58] Field of Search ..... 57/204, 205, 206, 208, 57/234, 242, 244, 231, 905, 209, 245; 428/198, 373, 293, 364, 375, 370; 156/166

[56] References Cited

U.S. PATENT DOCUMENTS

| | | | |
|---|---|---|---|
| 3,049,466 | 8/1962 | Erlich | 428/198 |
| 3,634,163 | 1/1972 | Lamb | 136/166 |
| 3,649,427 | 3/1972 | Hughes | 428/198 |
| 3,839,854 | 10/1974 | Carranza et al. | 57/236 |
| 4,013,816 | 3/1977 | Sabee et al. | 428/198 |
| 4,142,355 | 3/1979 | Chambley et al. | 57/293 |
| 4,166,357 | 9/1979 | Carranza et al. | 57/282 |
| 4,304,234 | 12/1981 | Hartman | 428/198 |
| 4,451,520 | 5/1984 | Tecl et al. | 428/198 |
| 4,490,425 | 12/1984 | Knoke et al. | 428/90 |
| 4,668,566 | 5/1987 | Braun | 428/198 |
| 4,696,850 | 9/1987 | Josf et al. | 428/198 |
| 5,199,141 | 4/1993 | Trask et al. . | |

*Primary Examiner*—Patrick J. Ryan
*Assistant Examiner*—N. Edwards
*Attorney, Agent, or Firm*—Vaden, Eickenroht, Thompson, Boulware & Feather

[57] ABSTRACT

The invention relates to a novel type of polyolefine yarns with good performance in the manufacture of rugs and carpets, made-up by admixing polypropylene filaments with polyethylene filaments, and by subjecting said filaments mixture to a temperature of from 125° C. up to 130° C., which substantially equals the melting temperature of the polyethylene filaments, whereby said polyethylene filaments become melted while the polypropylene filaments, with higher melting point, remain solid and stable, and with said melting of the polyethylene filaments constituting welding points for said polypropylene filaments, bulking and shaping the resulting yarn.

4 Claims, 6 Drawing Sheets

POLYOLEFINE YARNS WITH GOOD PERFORMANCE FOR RUGS AND CARPETS AND METHOD OF PRODUCING THE SAME

FIELD OF THE INVENTION

This invention relates to yarns, particularly to mixed yarns that have very good performance in the manufacture of rugs and carpets. Specifically, this invention is related to polyolefine yarns, very suitable for the manufacture of rugs, carpets and the like.

BACKGROUND OF THE INVENTION

The use of polyolefine fibers in the manufacture of rugs, carpets and the like would be very appealing from an economic standpoint. However, said use has been prevented due to the fact that said polyolefine fibers exhibit poor characteristics of recovery from collapsing and setting of the spinning conditions in order to preserve the original shape thereof through use. In other words, polyolefine fibers collapse easily under the steps of the users and do not recover quickly and efficiently into the initial upright condition of the fibers, whereby a rug made therefrom has no commercial acceptance.

In the production of rugs and carpets it is essential to use yarns which give the product an pleasant appearance and provide for the recovery of the upright position of the yarns following the collapse thereof. Also important are the wear resistance and their retaining of the original characteristics of twisting and plying during the entire useful life of the rug.

Up to this date, the state of the art has not obtained a yarn from polyolefinic fibers provided with the above stated characteristics of recovery into the upright condition of said fibers following the collapse thereof due to the steps of the user, as well as the spinning characteristics thereof, such as the twisting and plying of the fibers.

OBJECTS OF THE INVENTION

It is, accordingly, a main object of the invention to provide a yarn, based on polyolefines, suitable for the manufacture of rugs and carpets.

It is another object of this invention to combine several types of polyolefinic fibers, in such a manner that the mixture thereof provides a yarn suitable for the manufacture of the rugs and carpets as above recited.

It is a further object of this invention to provide a yarn for rugs, made up from two different fibers, being both economic and adaptable for the conventional manufacture of rugs and carpets.

BRIEF DESCRIPTION OF THE DRAWINGS

This invention will be more easily understood by reference to the attached drawings, wherein.

DETAILED DESCRIPTION OF THE INVENTION

Figure 1:
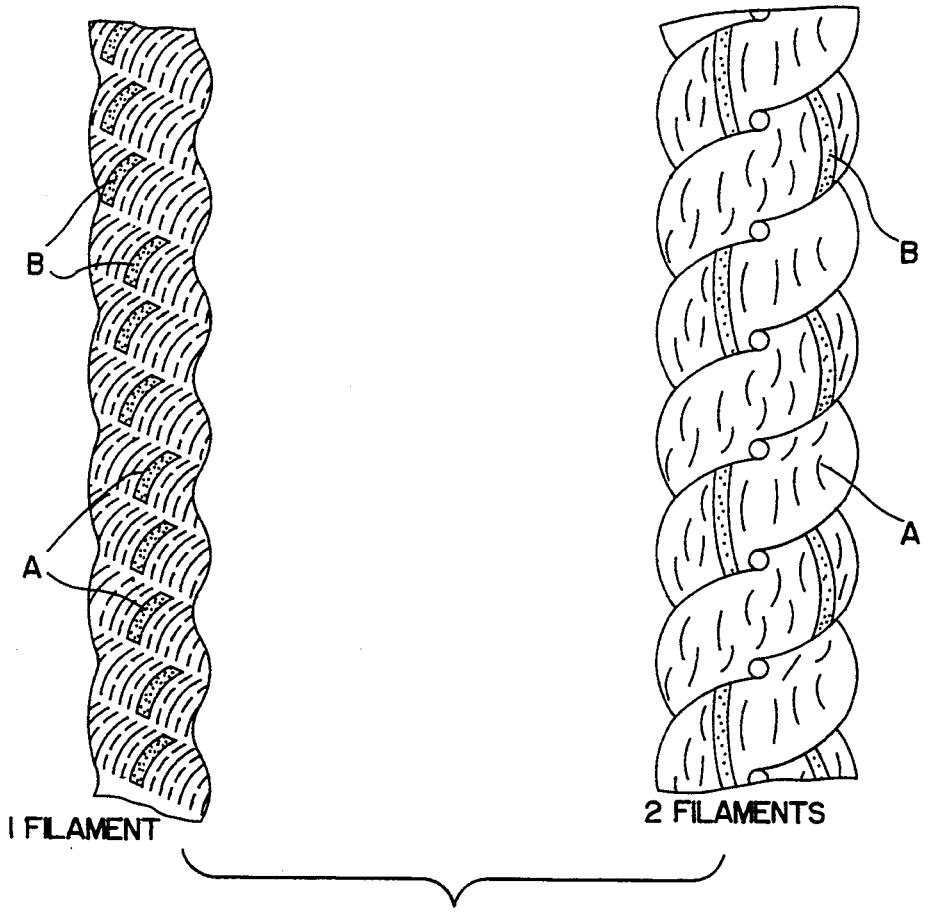
FIG. 1 is a view of a yarn of the invention, made up by at least two different filaments, ready to be subjected to the heat treatment process, there being shown a yarn made-up from one end and another one made-up from two ends, plied to one another.
Figure 2:
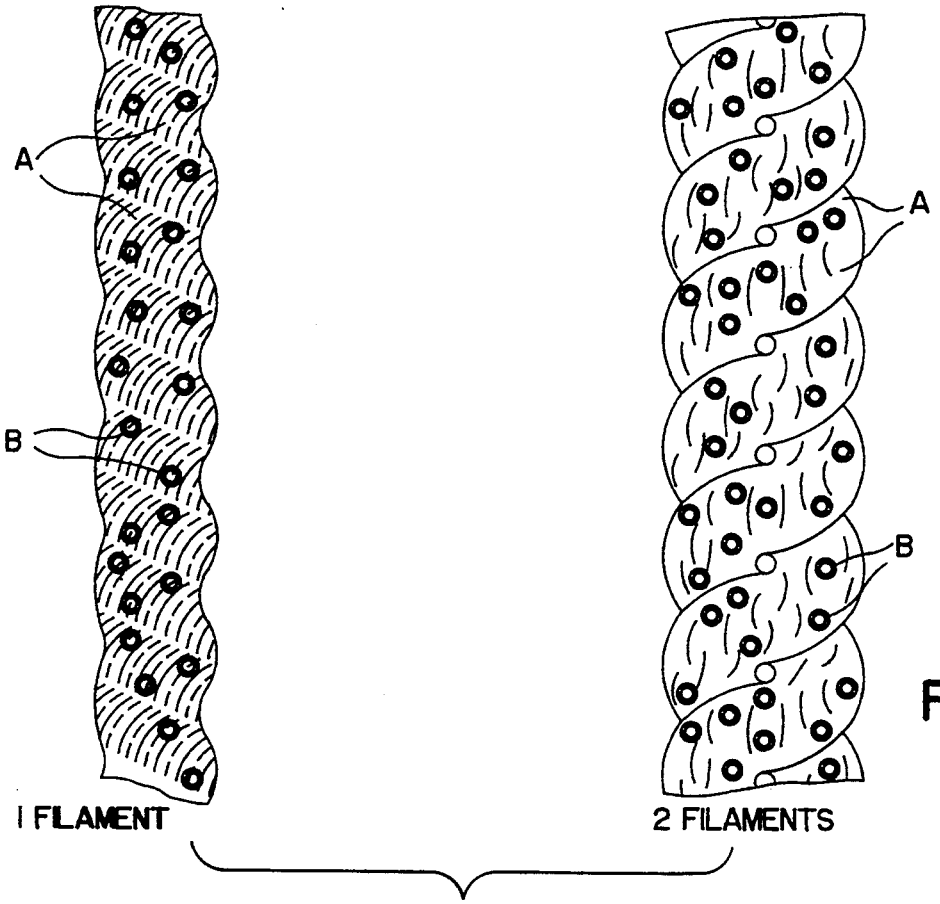
FIG. 2 is a schematic view of the yarn of this invention following the heat treatment and the melting of the polyethylene fiber, for the welding in various sites of two or more polypropylene fibers to each other by means of the polyethylene melted fibers, which have become contracted to the point of constituting just disperse welding points throughout the hank; which have been exaggerated in size in the respective views.

Referring now to FIG. 1, there can be seen that the yarn of the invention is made up from two filaments or threads A and B. As herein used, the term "fiber" defines the basic textile element, representing a single continuous and relatively short element, with defined and proper physical-chemical and textile characteristics. Natural fibers, such as cotton, wool, etc., have fibers of various sizes. On the contrary, the man-made synthetic fibers are all cutted to a length predetermined and selected by the producer, and are known as "staple" fibers or fibers of a predetermined length The term "filament" in turn represents an assembly of compact fibers forming a continuous element of greater length.

As used herein, the terms "threads" or "yarns" refer to the combination of two or more types of fibers or filaments, parallelized to each other, i.e., that have been oriented into the same direction and optionally plied to constitute a single combined element; in other words, yarns can be defined as a continuous welt, often plied, constituted by fibers or filaments and used to weave or constitute a cloth or textile fabric. Yarns can be used as a single end or two twisted ends. Said yarns can be subjected afterwards to a special treatment, according to their purported use.

Filament A is a polypropylene filament, and filament B is a polyethylene filament. As can be seen in the drawing, said two filaments are optionally plied to each other, thus forming a roving, or combined thread or yarn.

The invention is thus presented as a yarn or thread comprised of at least two different fibers, thermally bonded to each other, so as to constitute a good shaped yarn, particularly suitable for the manufacture of rugs. In a preferred embodiment of the invention, the base fibers, i.e., the predominant fibers are polyolefin fibers preferably comprising polypropylene fibers of trilobular section, 210 mm length, denier 12, dyed with organic or inorganic pigments during the struding thereof. Said fiber exhibits a melting point of 160° C. and represents about 90% of the entire mixture.

The at least another fiber is a low-density polyethylene, round section, 6.0 denier and 76 mm length, colorless fiber. Said fiber melts at about 120° C. and represents about 10% of the total weight of the yarn. A commercially available fiber, fully satisfying the requirements for this type of fibers in this invention, is that manufactured by HERCULES under the brand name of T-201. Hercules T-201 is a staple fiber of linear low-density polyethylene (LLDPE), designed for using in applications varying from special papers and industrial filters up to cosmetic applicators and hospital gowns. Staple fibers T-201 LLDPE can provide utmost smoothness and, at the same time, provide strength, stability and hot-bonding properties, necessary to satisfy the needs in these several applications of end use.

2.0 denier: 5.10 mm, 1-1/1 inches 3.0 denier: 1-$\frac{7}{8}$, 3 inches, 5 mm, 10 mm, 6.0 denier: 1-$\frac{1}{8}$, 3 inches, 5 mm, 10 mm 30.0 denier: 3-$\frac{1}{2}$ inches.

The ratio of the two fibers is obtained by means of suitable metering, since the critical aspect within the invention resides in the combination of the several filaments, defined as:

a) Polypropylene filament b) Polyethylene filament as the physical-chemical properties of said materials are what provides for the efficient combination thereof in a single end yarn.

| Physical-Chemical Properties Representative of Hercules T-201 Polyethylene | |
|---|---|
| Luster | Bright* |
| Melting point | 125° C. |
| Specific Gravity | 93 |
| Toughness | 3.0 g/den |
| Applications of Polyethylene T-201 | |
| Medical/Surgical | Coating Materials |
| Cleaning devices | Home appliances |
| Filters | Cosmetic Applicators |
| Special papers | Reinforcements |

*Denier 30 is also available in black.

Performance

Hercules T-201 staple fibers have been designed to be processed suitabaly by means of carding systems, air-deposition systems and wet-deposition systems, both in 100% fibers and in mixtures.

Smoothness and radiation resistance make LLDPE staple fibers T-201 a main candidate for water-entangled cloths and for medical/surgical applications.

The low melting point of LLDPE staple fibers T-201 allow the use thereof as a thermal bonder, by using already existing heat-transfer equipment, such as hot cylinders and curing stoves.

These performance properties, together with their direct thermo-stickiness to polyethylene films, make T-201 a natural component of several of the present highly sophisticated combined structures, such as the one proposed by the present invention.

The difference between the melting temperatures of said two fibers, allows obtaining of a yarn such as the one proposed by this invention. In fact, said polyolefinic fiber exhibits predominantely a melting point of about 160° C., which is relatively remote from the melting point of linear low-density polyethylene fiber, i.e., about 125° C. Thus, when the yarn formed by the above mentioned two fibers, plied to each other, is subjected to heat, the polyethylene fibers melt, while the polyolefin fibers maintain their integrity. In such a manner, the melted polyethylene fibers serve as welding points or spots for the polypropylene fibers, thus giving the assembly a bulklet shape and giving the assembly more volume and, at the same time, providing the yarn with a greater rigidity and recoverability of the position thereof. With suitable processing, said yarns can also be bulked to a high degree, due to the effect of different shrinkings of the fibers forming part of the admixture, whereby rugs of excellent covering and appearance can be manufactured.

Hereinbelow is given a brief comparative review of the respective properties of said at least two fibers, to be combined to constitute the yarns of the instant invention.

| Polypropylene fibers | Polyethylene fibers |
|---|---|
| Mero structure | Mero structure |
| $CH_2{=}CH{-}CH_3$ | $CH_2{=}CH_2$ |
| Melting point 160° C. | Melting point 125° C. |
| Trilobular Section Fibers 210 mm length, 12 denier | Round section fibers, low density, 76 mm length |
| Fiber color = dyed with organic inorganic pigments | Fiber color = colorless |
| Percentage in the yarn = 90% | Percentage in the yarn = 10% |

DESCRIPTION OF THE PROCESS

In an apparatus provided with scale and by means of transport mats, an admixture is made with predetermined ratios, which in this instance vary according to A/B ratios of from 85–90/15–10. Said fiber mixtures must be made by weight, with a suitable scale and are to be passed through a fiber opener.

Figure 3:
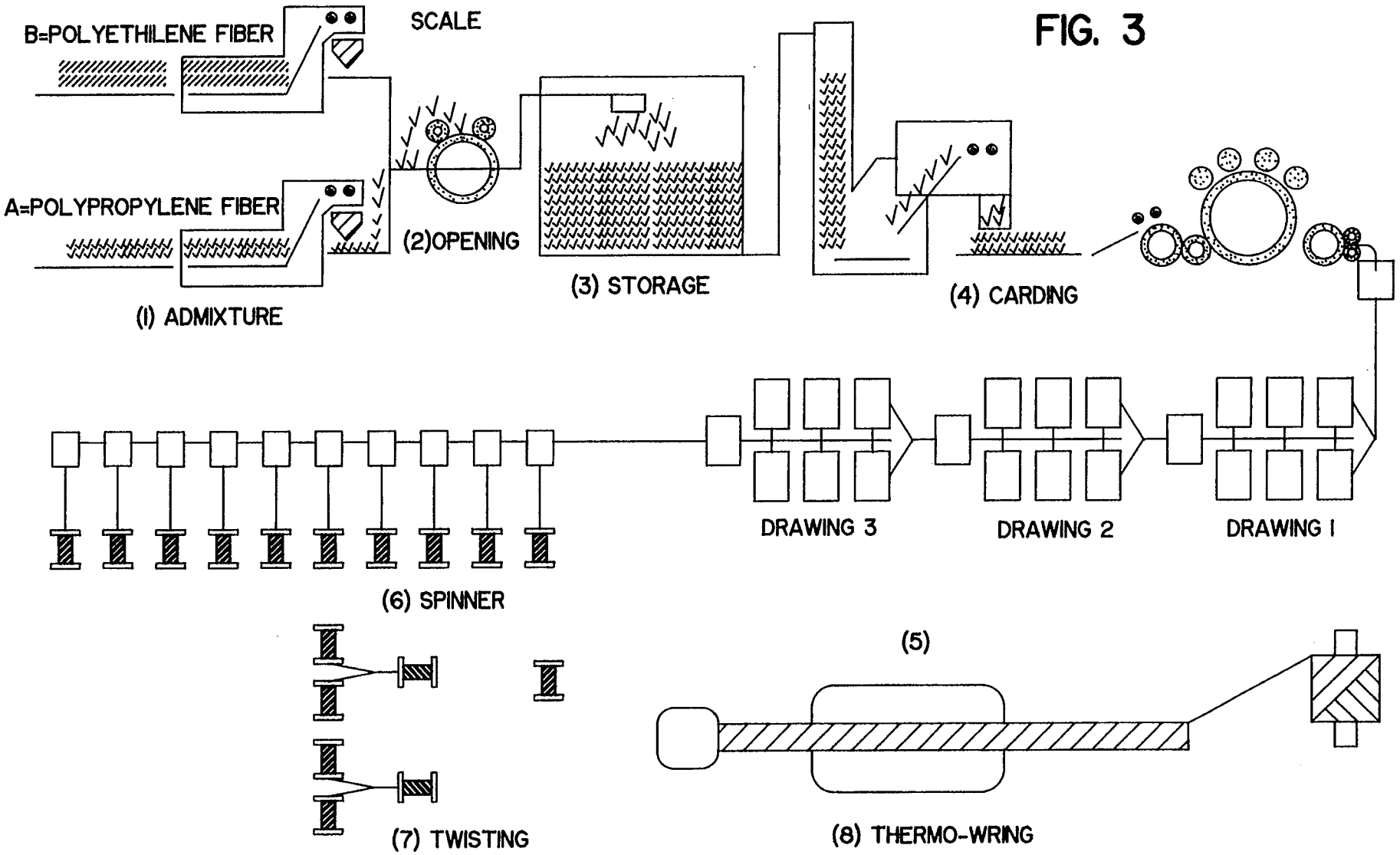
FIG. 3 is a diagrama illustrating the conventional process of spinning and thermosetting of the yarn employed in the process of this invention.

As illustrated herein in FIG. 3 of the process outline, said mixture is the step designed by numeral 1. Said mixture passes into an opener 2, formed by a barrel with rollers provided with spikes, wherein the fibers start to be admixed by means of said apparatus. From said apparatus, fibers are pneumatically carried into a storage place 3, wherein it is provided, at the top thereof, a centrifugal fiber distributing system, which contributes to the admixing thereof.

Figure 4:
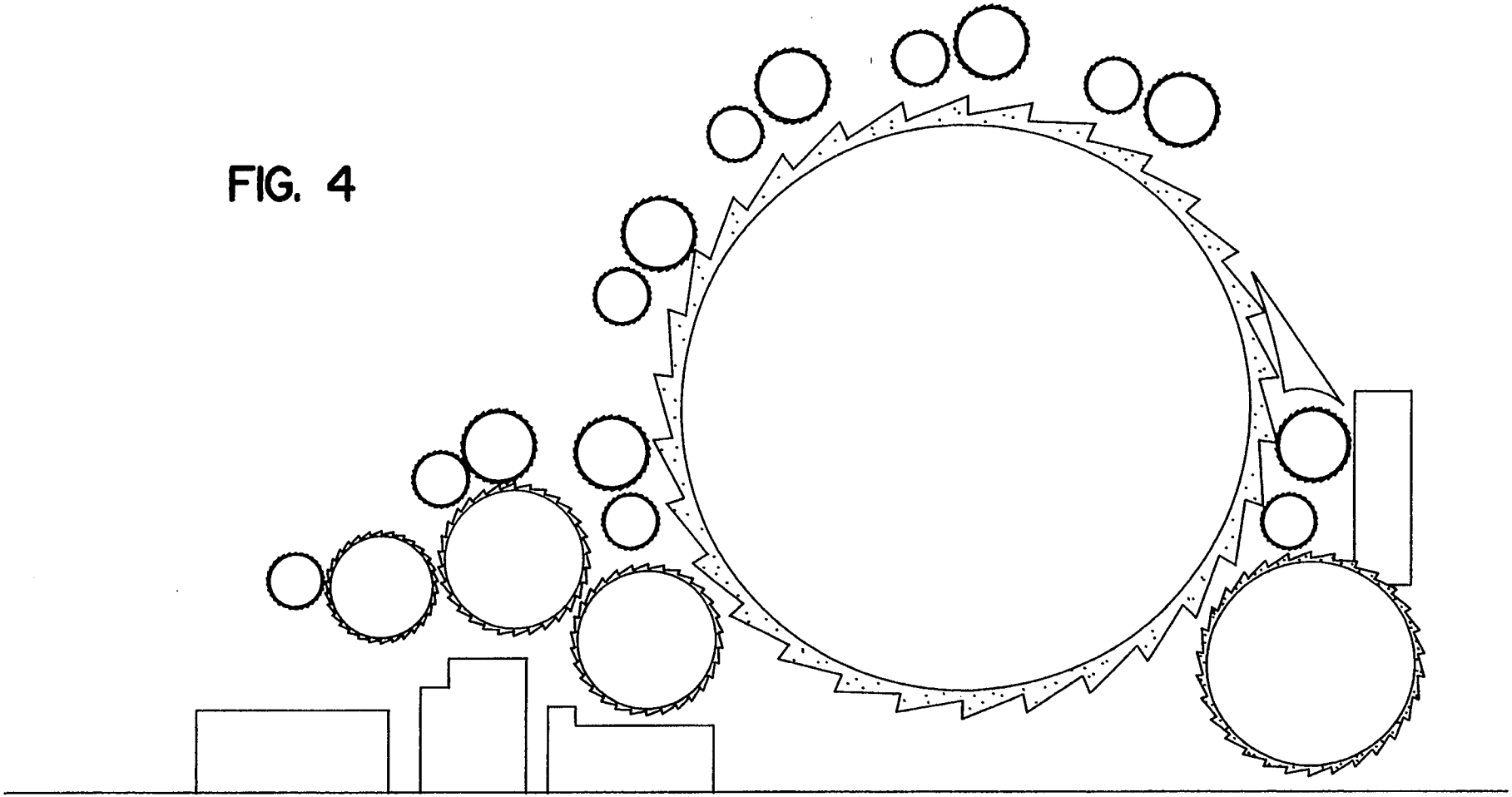
FIG. 4 is a schematic view of a conventional carding apparatus to card fibers, employed in the process of this invention.
Figure 6:
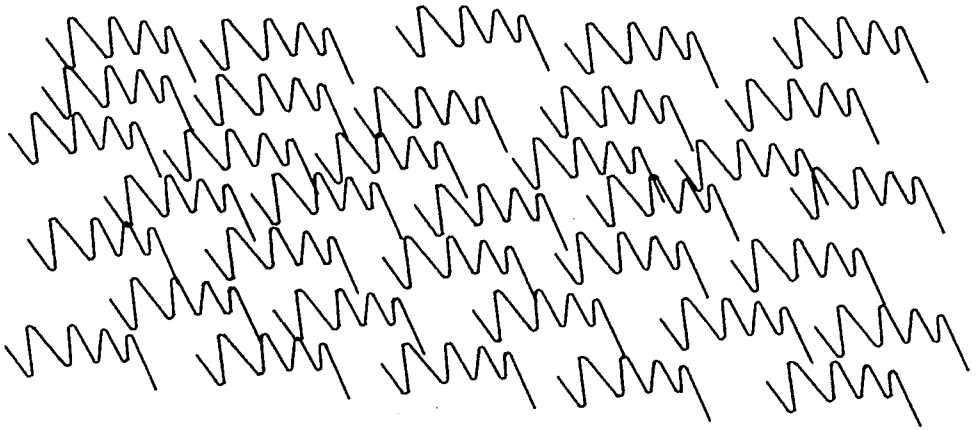
FIG. 6 shows the same bundle of fibers following the carding treatment in the apparatus as illustrated in FIG. 4.
Figure 5:
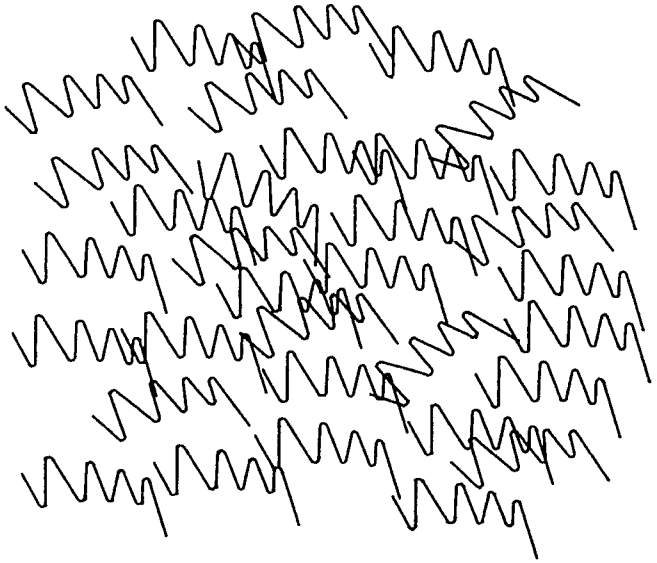
FIG. 5 illustrates conventional fibers, as they arrive to the premises, without having been subjected to a carding step.

Once mixed to each other, said fibers are passed to a carding process 4 by means of a card as shown schematically in FIG. 4; in said process, said non-oriented, interwoven and intermingled fibers, as those illustrated in FIG. 5, enter to a piked-rollers assembly wherein, due to the difference in the speed of said rollers in a longitudinal sense, said fibers are stepwise oriented and unintermingled in a longitudinal sense, in order to parallel them and order the same following the longitudinal sense, as illustrated in FIG. 6. Said oriented and paralleled fibers thus constitute a "roving" or "welt" which is the base for the further formation of a "thread" or "yarn".

From the carding process, said roving or sliver comes out with a weight of about 30 grams for every linear meter. Said carded sliver is then given a three-step stretching so as to reach a weight of 5.0 to 6.5 g/linear meter. In other words, said prior roving, sliver or yarn with a weight of 30 g/linear meter is reduced, by means of the stretching thereof in three consecutive steps, so as to reduce the diameter thereof and, accordingly the weight thereof, to the specified weight of about 5.0 to 6.5 g/linear meter. Next, in spinning machines, said yarn is given a twisting with a torsion coefficient of from 65 to 70. The torsion coefficient is defined as the result of dividing the twisting suffered by one meter of yarn by the square root of the title, expressed in the metric numeral as defined hereinabove. Then, the stretching of the yarn must commence, wherein said fibers, due to the stretching thereof, become oriented in a greater degree and the roving or sliver is simultaneously twitted down to the desired end size, according to the following sequence:

| | Carding (4) | Stretching (5) 1 | 2 | 3 | Spinning (6) |
|---|---|---|---|---|---|
| Silver weight (g) | 30 | 10.0 | 6.5 | 5.0 | 0.25 |

During the stretching process, said fibers are also admixed, due to the fact that, in each of said three steps of stretching, some 8 to 10 slivers are put together to constitute a single sliver which, in turn, is admixed with an even number of slivers to constitute then another single sliver.

Figure 7:
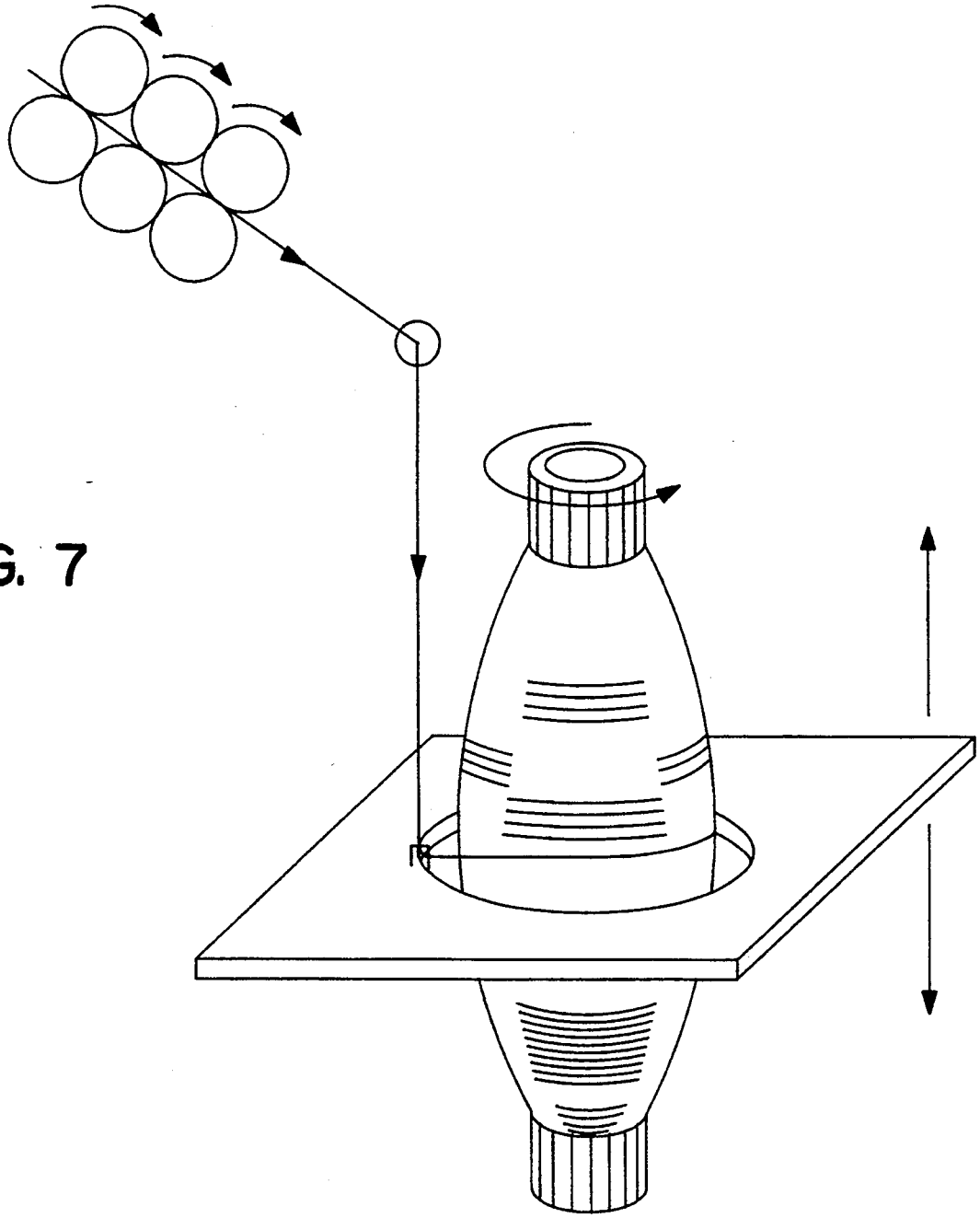
FIG. 7 illustrates the process of forming a yarn by means of a drawing and twisting process of the slivers or rovings.

In the spinning process, said slivers or rovings are subjected to a stretching and twisting process to form a thread or yarn. This spinning process is illustrated in FIG. 7, where it can be seen the use where the formed thread has been wound up. In the thread, the twistings are graded according to an established amount of torsion, as per the following formula:

$$Torsion/meter = 65 \times V\ title$$

These threads are plyed in a plying machine with 80% of the original torsion of the yarn for one end but in a reverse sense. The value of 65 in the above formula is known as the torsion coefficient which has been experimentally determined for these yarns to be between 65 and 70.

Said thread or yarn, as needed for the desired and predetermined type of rug, can be of a single thermally stabilized end or can be of two or more plied, later thermally stabilized ends. In a so-called ring plying machine (FIG. 7) said two (2) single ends are plied in order to form another one which, in the terms used in this field, is identified by the stating of the title of the single end, followed by the number of ends. Thus, in the case of the two plied ends as above recited, the new thread or yarn is identified as 4.0/2, which would mean that there are two plied ends and that they have a title of 4.0.

This one-ended yarn, or two plied ends yarn, is then passed to a thermal process wherein component B is melted at 125° C. Said threads are passed through a tunnel of a conventional type in the textile industry, at 140° C. and at a high speed. By using the trial and error method, the residence time in the tunnel, needed for the polyethylene fiber to become melted, has been determined to be of about 80 seconds. The yarn, previously banked about endless strings, is treated with hot air at a tempereature of ±140° C. and, simultaneously with injection of overheated steam at a pressure of 31.05 kPa (4.5 psi). Under said thermal conditions, the polyethylene fibers having a melting point of 125° C. melt within the yarn, whilst polypropylene fibers remain solid, intact and unmelted. In its melted condition, said polyethylene fiber produces a kind of welding on the unmelted polypropylene fibers, on randomly dispersed sites. The ratio of the respective fibers (90% polypropylene and 10% polyethylene), upon being well admixed to each other, according to the mixing, carding and spinning process, as above recited, makes the welding points presented as suitably distributed throughout the hank.

Figure 8:
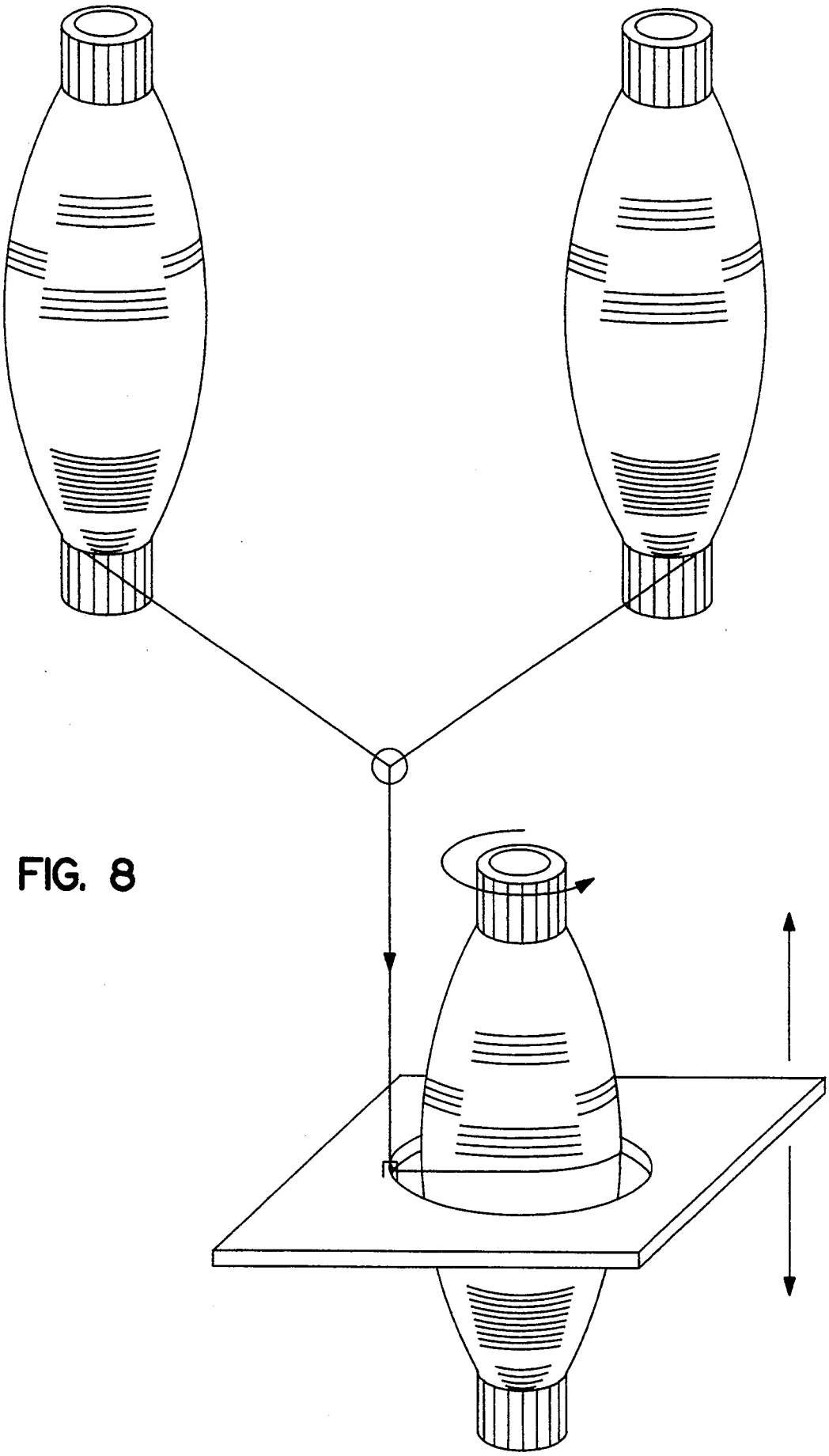
FIG. 8 illustrates the process of plying two ends.

Likewise, the conditions of time, heat, temperature and humidity result in shrinking and "swelling" whereby said yarn acquires a certain bulk as per the scheme illustrated in FIG. 8. The melting of polyethylene fibers produces the shrinking of the respective fiber, thus making the entire yarn shrink also. However, steam produces an expansion of the yarn, which expands due to this reason and produces likewise an expansion of the yarn assembly, thus obtaining a bulking or shaping effect in rugs and carpets. Under the conditions of the above described process, a shrinking of the yarn is obtained of between about 7.0 and 10%, which is enough for a good bulking of the yarn.

Having thus described and illustrated the invention, it is not intended that the same be limited to the particular terms employed in this disclosure, whereby the invention is to be limited only by the appended claims.

What is claimed is:

1. A polyolefin yarn, comprising a plurality of polypropylene filaments and a plurality of polyethylene filaments, with said polypropylene and polyethylene filaments welded to each other in an unorderly manner in randomly distributed welding spots along the yarn, and with said welding spots being the result of the melting of said polyethylene filaments.

2. Polyolefin yarn according to claim 1, characterized in that said melted polyethylene filaments constituting the welding spots of the polypropylene yarns, represent from about 10% to 15% of the total weight of the yarn.

3. A yarn according to claims 1 or 2, characterized in that said polypropylene filaments represent from about 85% to 90% of the weight of said yarn.

4. A yarn according to one of claims 1 through 3, characterized in that said polypropylene filaments are dyed.

* * * * *